US009558728B2

(12) United States Patent
Torimura et al.

(10) Patent No.: US 9,558,728 B2
(45) Date of Patent: Jan. 31, 2017

(54) SETTING AND EDITING TONE SETTING INFORMATION VIA LINK

(71) Applicant: YAMAHA CORPORATION, Hamamatsu-shi, Shizuoka (JP)

(72) Inventors: Hiroyuki Torimura, Hamamatsu (JP); Akemi Kubita, Hamamatsu (JP)

(73) Assignee: YAMAHA CORPORATION, Hamamatsu-shi (JP)

( * ) Notice: Subject to any disclaimer, the term of this patent is extended or adjusted under 35 U.S.C. 154(b) by 0 days.

(21) Appl. No.: 14/773,823

(22) PCT Filed: Dec. 15, 2014

(86) PCT No.: PCT/JP2014/083156

§ 371 (c)(1),
(2) Date: Sep. 9, 2015

(87) PCT Pub. No.: WO2015/107823

PCT Pub. Date: Jul. 23, 2015

(65) Prior Publication Data

US 2016/0027419 A1 Jan. 28, 2016

(30) Foreign Application Priority Data

Jan. 16, 2014 (JP) ..... 2014-005588

(51) Int. Cl.
*G10H 1/00* (2006.01)
*G10H 1/18* (2006.01)
(Continued)

(52) U.S. Cl.
CPC ..... *G10H 1/18* (2013.01); *G10G 1/04* (2013.01); *G10H 1/043* (2013.01); *G10H 1/053* (2013.01);
(Continued)

(58) Field of Classification Search
CPC ..... G10H 1/0025; G10H 1/0058; G10H 1/02; G10H 2210/066; G10H 1/24; G10H 2210/155; G10H 2220/371; G10H 2240/131; G10H 1/0033; G10H 2240/016; G10H 2240/125; G10H 2210/165;G10H 2210/211; G10H 2210/325
See application file for complete search history.

(56) References Cited

U.S. PATENT DOCUMENTS 6,303,852 B1 * 10/2001 Kizaki ..... G10H 1/0066 84/622
2003/0029304 A1 * 2/2003 Ochi ..... G10H 1/0066 84/609
(Continued)

FOREIGN PATENT DOCUMENTS

JP 59126595 A 7/1984
JP 03223795 A 10/1991
(Continued)

OTHER PUBLICATIONS

International Search Report issued in PCT/JP2014/083156, dated Mar. 17, 2015. English translation provided.
(Continued)

*Primary Examiner* — Marlon Fletcher
(74) *Attorney, Agent, or Firm* — Rossi, Kimms & McDowell LLP

(57) ABSTRACT

A storage device stores a plurality of sets of tone setting information, each of the sets of tone setting information including one or more tone setting parameters. The storage device also stores, for each of the sets of tone setting information, a link ID identifying a link set in association with the set of tone setting information. Processing is performed to cause, based on the link IDs, settings of the tone setting parameters to match between a plurality of sets of the tone setting information having a same link ID. A selected set of the tone setting information is editable in accordance with a user operation. In accordance with the editing, processing is performed to cause a setting of any one of the tone setting parameters in one or more other sets of the tone setting information, having a same link ID as the link ID associated with the edited set of the tone setting infor-
(Continued)

mation, to match a setting of the tone setting parameter in the edited set of the tone setting information.

9 Claims, 4 Drawing Sheets

(51) Int. Cl.
*G10G 1/04* (2006.01)
*G10H 1/043* (2006.01)
*G10H 1/053* (2006.01)
*G10H 1/24* (2006.01)

(52) U.S. Cl.
CPC ..... *G10H 1/24* (2013.01); *G10H 2220/106* (2013.01)

(56) References Cited

U.S. PATENT DOCUMENTS

2005/0066797 A1* 3/2005 Miyamoto ..... G10H 1/0058 84/615
2005/0155484 A1* 7/2005 Yanase ..... G10H 1/0058 84/615
2005/0257667 A1* 11/2005 Nakamura ..... G10H 1/0008 84/609
2006/0248173 A1 11/2006 Shimizu
2012/0192701 A1* 8/2012 Watanabe ..... G10H 1/40 84/622
2012/0222540 A1* 9/2012 Usui ..... G10H 1/0025 84/622
2016/0027419 A1* 1/2016 Torimura ..... G10G 1/04 84/615

FOREIGN PATENT DOCUMENTS

JP 2002169560 A 6/2002
JP 2002341869 A 11/2002
JP 2007164120 A 6/2007
JP 2008158435 A 7/2008

OTHER PUBLICATIONS

"STAGEA ELS-01/01C/01X typeU Manual", Yamaha Corp., Toriatsukai Setsumeisho [online], v1.83, 2011, p. 94-96 [retrieval date Feb. 19, 2015], <http://www2.yamaha.co.jp/manual/pdf/emi/japan/ele/els01v183_ja_om_d0.pdf>. Partial English translation provided.

* cited by examiner

SETTING AND EDITING TONE SETTING INFORMATION VIA LINK

FIELD OF THE INVENTION

The present invention relates to a technique for setting and editing, as desired, tone setting information that is intended to set characteristics of a tone to be generated by an electronic musical performance apparatus, such as an electronic musical instrument.

BACKGROUND OF THE INVENTION

In the conventionally-known electronic musical instruments, characteristics of a tone to be generated by the electronic musical instrument can be set by tone setting information comprising tone setting parameters intended to set a color (timbre), quality, musical characteristics, etc. of the tone to be generated by the electronic musical instrument. By preparing (registering) a plurality of sets of such tone setting information through creation or editing of tone setting information, it is possible to generate tones of a plurality of different characteristics or types. When a human player (or user) uses tone setting information in such an electronic musical instrument, the human player (user) may often use same tone setting information in different scenes (e.g., in different performance parts and difference phrases). Generally, however, each tone setting information includes a plurality of tone setting parameters, and there are prepared a plurality of sets of such tone setting information. Thus, the total number of parameters can become extremely large. Therefore, in a case where a tone setting parameter of a setting state (setting) is to be used between (among) a plurality of sets of tone setting information, setting or editing of the tone setting parameter of the same setting has to be performed for each of the sets of tone setting information, which is extremely cumbersome.

Thus, there has heretofore been known a technique for collectively setting a plurality of parameters of a same type at a same value. For example, in STAGEA ELS-01/01C/01X typeU, instruction manual (p 94-p 96), [online], published in 2011, [searched on Dec. 18, 2013], Internet URL: http//www2.yamaha.co.jp/manual/pdf/emi/japan/ele/els01v183_ja_om_d0.pdf (hereinafter referred to as "Non-patent Literature 1"), there is disclosed a technique in which a multiplicity of sets (e.g., three hundred sets) of registration data, each of the sets comprising tone setting information for eight performance parts, are registrable, in which a user selects one parameter type (e.g., any one of reverberation, pan, etc.) on which collective editing is to be performed, one or more performance parts (e.g., upper keyboard, lower keyboard, etc.) to which the collective editing is to be applied, and one or more sets of registration data to be set as objects of the collective editing, and in which, in response to the user editing a value of the parameter of the selected type, the edited value of the parameter of the selected type is collectively reflected in all of the selected performance parts in all of the selected register data.

PRIOR ART LITERATURE

Non-Patent Literature

Non-patent Literature 1: STAGEA ELS-01/01C/01X typeU, instruction manual (p 94-p 96), [online], published in 2011, [searched on Dec. 18, 2013], Internet URL: http//www2.yamaha.co.jp/manual/pdf/emi/japan/ele/els01v183_ja_om_d0.pdf With such a prior art technique, where a plurality of pieces of tone setting information are edited collectively, user's operations tend to be cumbersome. Namely, according to the aforementioned prior art technique, only one type of parameter to be collectively edited is selected and then editing is performed to increase or decrease a value of the parameter of the selected type and thereby change values of the individual parameters of the selected type pertaining to one or more selected performance parts in all of regist data selected as objects of collective editing. However, because the total number of parameter types is extremely large, an operation for selecting a desired parameter type from among a large number of parameter types would require considerable attentiveness or attention and thus would be cumbersome. Further, in a case where a plurality of types of parameters are to be collectively edited, the aforementioned collective editing work has to be performed for each of the parameter types, which would be very cumbersome. In addition, in order to set the parameters at their respective ideal values, a trial performance of a music piece is executed a plurality of times in many cases. Namely, in many cases, operations are performed to finely modify parameter values per trial performance so that the parameters gradually approach the ideal values. In such a case, the collective editing work has to be performed again per parameter value modification, which would be extremely cumbersome. Furthermore, if a mistake of forgetting to select a performance part or a portion of regist data that should be selected occurs during editing, then it would become extremely difficult to end the editing work in an appropriate manner.

SUMMARY OF THE INVENTION

In view of the foregoing prior art problems, it is an object of the present invention to provide a technique which allows a type of parameter to be readily collectively set or edited between (among) a plurality of sets of tone setting information including the type of parameter.

In order to accomplish the above-mentioned object of the present invention, the present invention provides an apparatus for setting tone setting information, which comprises: a storage device storing a plurality of sets of tone setting information, each of the sets of tone setting information including one or more tone setting parameters, the storage device also storing, for each of the sets of tone setting information, a link ID identifying a link set in association with the set of tone setting information; and a processor configured to cause, based on the link IDs, settings of the tone setting parameters to match between a plurality of sets of the tone setting information having a same link ID.

According to the apparatus of the present invention, which is constructed to store a link ID (identification information) in association with each individual set of tone setting information, a link can be set between (among) a plurality of sets of tone setting information via a common or same link ID. The substance of setting such a link comprises causing settings of the tone setting parameters included in the tone setting information to match between (among) a plurality of sets of the tone setting information having a same link ID. Thus, a setting of the tone setting parameter can be automatically collectively set or edited between (among) a plurality of sets of the tone setting information through processing by the processor and via the stored same link ID. Namely, once a link is set via the same ID, editing performed on a given set of tone setting information can be automatically reflected in one or more other sets of tone setting information linked to the given set of tone setting information, without cumbersome editing work being performed separately per modification as performed in the prior art technique. Further, a link is set per set of tone setting information as noted above, and thus, in the case where each set of tone setting information comprises a plurality of parameters, editing performed on all the parameters included in a given set of tone setting information can be reflected in one or more other sets of tone setting information linked to that given set without the parameter types that are to be collectively edited being selected one by one as done in the prior art technique. Therefore, even where modification of a same set of tone setting information is repeated, one or more other sets of tone setting information linked to the modified set of tone setting information can also be readily collectively modified. Further, unlike in the prior art technique, the present invention can avoid a mistake of forgetting to select a performance part and resist data to be subjected to collective modification when modification is to be repeated, and thus, the present invention allows editing work to be completed in a normal or appropriate manner.

In an embodiment, the processor may be further configured to edit selected one of the plurality of sets of the tone setting information in accordance with a user operation, and the processor may be configured to cause a setting of any one of the tone setting parameters in one or more other sets of the tone setting information, having a same link ID as the link ID associated with the edited set of the tone setting information, to match a setting of the tone setting parameter in the edited set of the tone setting information.

According to the embodiment, an editing section for editing the selected one of the plurality of sets of the tone setting information may be configured to be capable of editing tone setting parameters; as an example, the editing section may be configured to receive edited content by means of various UIs (User Interfaces). For example, the edit section may be configured to edit the tone setting parameter by displaying a current value of the tone setting parameter on a UI screen displayed on a display device and receiving modification of the tone setting parameter on the basis of information input via the UI screen. Needless to say, in the case where each set of tone setting information comprises a plurality of parameters, it is preferable that the editing section be configured to be capable of individually editing each of the parameters.

Processing performed by the processor for causing, on the basis of the link IDs, settings of the tone setting parameters to match between (among) a plurality of sets of the tone setting information having a same link ID may be performed at any desired timing or time point unless there is involved a particular inconvenience. For example, when a setting of a tone setting parameter in a given set of tone setting information having a given link set therefor has been modified or edited through editing, content of such editing (edited content) may be reflected in one or more other sets of tone setting information having (i.e., having set therefor) the same link as the given set, either promptly in response to the editing or at appropriate timing following or subsequent to the editing. In short, it only suffices that the reflection of the edited content be completed at least before the sets of tone setting information are used for tone generation.

Various timing is assumable as timing at which edited content is to be reflected. For example, edited content may be reflected at desired timing subsequent to the editing, e.g. at a time point when an editing end, link reflection or the like has been instructed, or each time editing is performed. In the former case, it can be made easier to add various constructions for enhancing convenience of the editing work, such as; canceling the editing before reflection of the edited content; and, regarding a portion of tone setting information having a link set therefor (i.e., link-set tone setting information), reflecting the edited content after canceling the link.

Further, according to the present invention, the arrangement of storing, for each of the sets of tone setting information, the link ID identifying the link set in association with the set allows the edited content of a given set of tone setting to be readily reflected in one or more other sets of tone setting information via a common or same link ID. Further, with such an arrangement, an already-set link can be readily changed or canceled by changing or deleting the link ID (including presentation of an identification indicator indicating that no link is currently set). Note that the arrangement of storing, for each of the sets of tone setting information, the link ID in association with the set does not require that the link IDs be stored in a same memory area or bank as that where the sets of tone setting information are stored. For example, a list or table indicative of correspondence between individual sets of tone setting information and individual link IDs may be stored in a memory area or bank different from that where the sets of tone setting information are stored.

Further, in one embodiment, the apparatus of the present invention may further comprise a link information memory that stores, in association with each link ID, the one or more tone setting parameters in a set of the tone setting information identified by the link ID, and the processor may be configured to cause, by referencing the link information memory based on the link ID, settings of the tone setting parameters to match between a plurality of sets of the tone setting information having a same link ID.

According to the embodiment, by referencing the link information memory in accordance with the link ID, it is possible to acquire a set of tone setting information (one or more tone setting parameters) specific to the link ID. The link information memory appropriately stores the one or more tone setting parameters, and thus, if content of any of the tone setting parameters of the tone setting information has been changed through editing or the like, the link information memory is, of course, updated. Thus, by referencing the link information memory, it is possible to ready identify settings of a set of tone setting information corresponding to a particular link ID (i.e., settings following the editing). Note that the link ID to be used for referencing the link information memory only has to be information capable of identifying a particular link; for example, the link ID may be information capable of directly or indirectly identifying a storage location in a recording medium as the link information memory, such as information indicative of a particular address in the recording medium.

In an embodiment, the storage device may include: a registration memory storing a plurality of sets of registration data, each of the sets of registration data comprising a plurality of sets of tone setting information individually corresponding to a plurality of performance parts; and a current memory storing the plurality of sets of tone setting information constituting a set of registration data, the plurality of sets of tone setting information stored in the current memory being editable in accordance with a user operation, a set of registration data being writable or readable from the current memory into the registration memory or from the registration memory into the current memory, and the processor may be configured to perform, in accordance with editing of any one of the sets of tone setting information stored in the current memory or editing of the link ID corresponding to the one of the sets of tone setting information, processing such that a setting of any one of the tone setting parameters matches between the one of the sets of tone setting information and one or more others of the sets of tone setting information having a same link ID as the one of the sets of tone setting information.

According to the embodiment, tone setting information editing work is performed on the tone setting information stored in the current memory. Prior to the processing for causing settings of the tone setting parameters to match between one of the sets of tone setting information being currently edited in the current memory and one or more others of the sets of tone setting information having a same link ID as the one set of tone setting information (i.e., edited content reflection process), cancellation of the editing, cancellation of the link, etc. can be done without influencing the other sets of tone setting information.

Further, in an embodiment, the apparatus of the present invention may further comprise a display device, and the processor may be further configured to: present a single user interface screen on the display device so that, for editing of a set of the tone setting information, selecting any one of a plurality of predefined voices and selecting any one of a plurality of already-set links can be performed on the single user interface screen; in response to selection of any one of the plurality of predefined voices, display the tone setting parameter for controlling the selected predefined voice so that the displayed tone setting parameter can be edited in accordance with a user operation; and in response to selection of any one of the plurality of already-set links, display the one or more tone setting parameters included in a set of the tone setting information corresponding to the selected already-set link so that any one of the displayed tone setting parameters can be edited in accordance with a user operation.

The embodiment is constructed to present the single interface screen on the display device such that, for editing any one of the sets of tone setting information, both selecting any one of a plurality of predefined voices (tone colors) and selecting any one of a plurality of already-set links can be performed on the single user interface screen. Further, a user interface screen for performing editing of the tone setting parameters to control the selected voice and an user interface screen for performing editing of the one or more tone setting parameters included in the set of tone setting information corresponding to the selected link are designed to edit tone setting parameters of similar configurations, the two user interface screens can be of a similar construction. Thus, the user is allowed to perform link-related editing operations with a same feeling as in primary tone setting parameter editing work, which can thereby achieve an enhanced convenience of use.

The present invention may be constructed and implemented not only as the apparatus invention discussed above but also as a method invention. Also, the present invention may be arranged and implemented as a software program for execution by a processor, such as a computer or DSP, as well as a non-transitory computer-readable storage medium storing such a software program. In such a case, the program may be supplied to a user in the storage medium and then installed into a user's computer, or delivered from a server apparatus to a client computer via a communication network and then installed into the client computer. Further, the processor employed in the present invention is not limited only to a computer or other general-purpose processor capable of executing desired software programs and may be a dedicated processor equipped with a dedicated logic circuit constructed of hardware.

DETAILED DESCRIPTION OF THE INVENTION

(1) Apparatus Construction

Figure 1A:
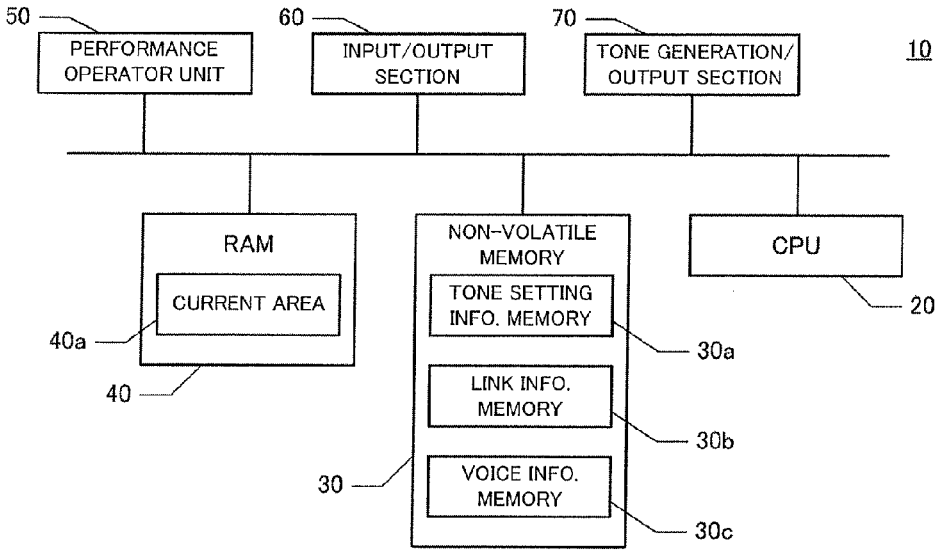
FIG. 1A is a block diagram of an apparatus for setting tone setting information in accordance with an embodiment of the present invention.

FIG. 1A is a block diagram of an apparatus for setting tone setting information in accordance with an embodiment of the present invention. The embodiment of the tone setting information apparatus of the present invention is incorporated in a component of an electronic musical instrument 10, and FIG. 1A schematically shows primary structural components of the electronic musical instrument 10. The electronic musical instrument 10 shown in FIG. 1A is capable of executing a performance in response to a user operating a performance operator unit (e.g., keyboard) 50. The electronic musical instrument 10 includes a CPU 20, a non-volatile memory 30, a RAM 40, the performance operator unit 50, an input/output section 60, and a tone generation/output section 70. The performance operator unit 50 is an operator unit, such as a keyboard, which is operable by the user to designate a tone to be output. The input/output section 60 includes an input section for inputting instructions from the user etc., and an output section for outputting various information (image information and audio information) to the user. Let it be assumed here that the input/output section 60 is in the form of a display device (output section) equipped with a touch panel (input section).

The tone generation/output section 70 includes a circuit and a speaker for generating and audibly outputting a tone responsive to a user's operation on the performance operator unit 50. The CPU 20 is capable of executing programs stored in the non-volatile memory 30 using the RAM 40 as a temporary storage area. By executing one of such programs, the CPU 20 identifies content of a user's operation on the performance operator unit 50 and identifies, on the basis of tone setting information prepared in advance, a tone source (tone color) and generation or control style to be used for generating a tone being performed. Then, the CPU 20 instructs the tone generation/output section 70 to generate and output a tone, corresponding to the operation on the performance operator unit 50, with the tone source and generation or control style designated by the tone setting information. In response to the instruction given from the CPU 20, the tone generation/output section 70 generates a tone signal of the instructed tone and amplifies and audibly outputs the tone signal through the speaker.

In order to realize such tone setting in a performance, the non-volatile memory 30 in the instant embodiment includes a tone setting information memory (registration memory) 30*a*, a link information memory 30*b* and a voice information memory 30*c*. Further, the electronic musical instrument 10 is constructed to be capable of performing tone setting with respect to m (m is a number of two or more) performance parts defined in accordance with musical factors, such as manual performance parts (locations of the performance operator units (keyboard) 50 like a right-hand keyboard region, left-hand keyboard region and a foot keyboard regions) and automatic accompaniment performance parts. Further, in the instant embodiment, n (n is one or a plural number) sets of registration data are registrable, with each of the n sets comprising tone setting information of the m performance parts. Note that each such set of registration data comprising tone setting information of the m performance parts will hereinafter also be referred to simply as "registration" or "regist".

Figure 2A:
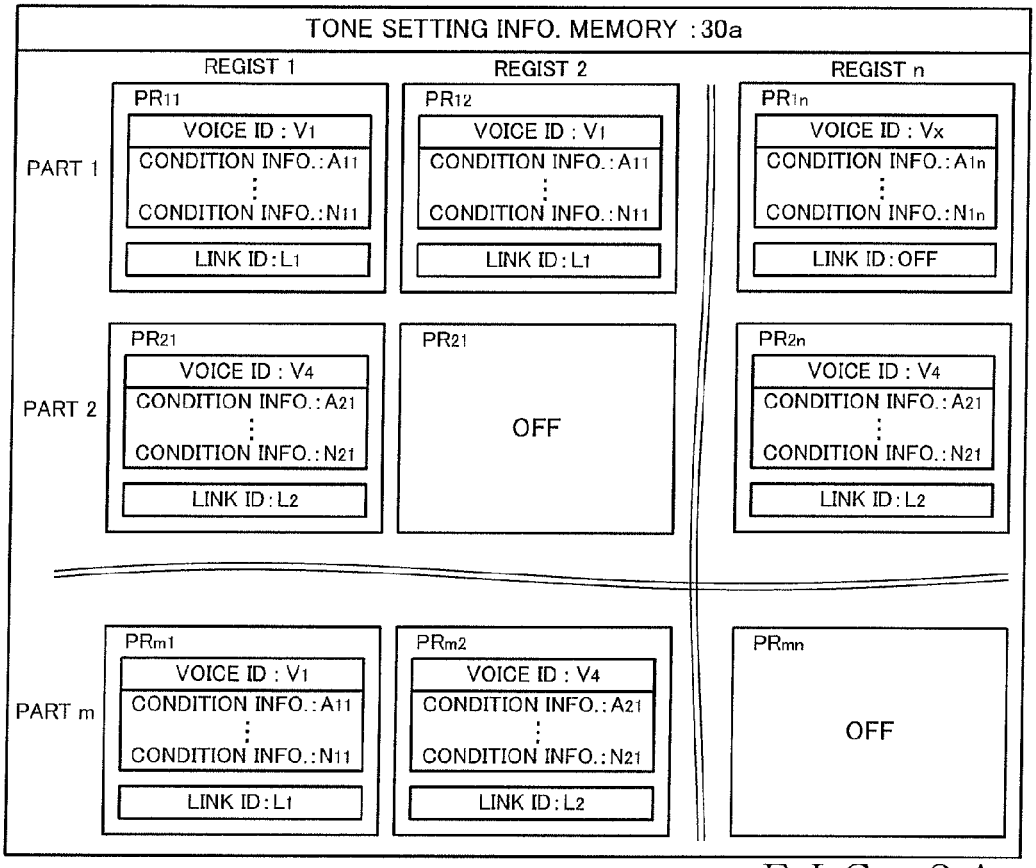
FIG. 2A is a schematic view showing an example construction of a tone setting information memory.

FIG. 2A is a schematic view showing a construction of the tone setting information memory (or registration memory) 30*a*. The tone setting information memory 30*a* stores a plurality of sets of tone setting information, and each of such sets of tone setting information includes one or more tone setting parameters. In the instant embodiment, the tone setting information memory 30*a* functions as a registration memory storing a plurality of sets of registration data. In the illustrated example of FIG. 2A, a set of tone setting information (e.g., $PR_{11}$ in the figure) includes a plurality of tone setting parameters ($V_1$ and $A_{11}$-$N_{11}$ in the figure) for one performance part (e.g., part 1 in the figure). A set of registration data (e.g., regist 1 in the figure) includes such sets of tone setting information (e.g., $PR_{11}$-$PR_{m1}$ in the figure) corresponding to individual ones of a plurality of performance parts 1-m. Namely, a set of registration data (e.g., regist 1 in the figure) is a collection of a plurality of sets of tone setting information ($PR_{11}$-$PR_{m1}$ in the figure) corresponding to a plurality of performance parts 1-m. The tone setting information memory (registration memory) 30*a* stores a plurality of sets of such registration data (regist 1-regist n). In FIG. 2A, for convenience sake, "PR" is used as a reference character indicative of a set of tone setting information, a particular performance part is indicated by a first digit of a two-digit suffix attached to the reference character "PR", and a particular regist is indicated by a second digit of the two-digit suffix. Thus, for example, "$PR_{mn}$" indicates a set of tone setting information for a performance part m in a given regist n. Hereinafter, "PR" with the two-digit suffix omitted therefrom will be used as a reference character indicating a set of tone setting information (for one performance part) in a generalized form.

Further, in the instant embodiment, a plurality of parameters constituting a set of tone setting information PR (for one performance part) comprise information indicative of a tone source waveform (voice ID), and a plurality of types of condition information indicative of a tone generation or control style. The information indicative of a tone source waveform (also referred to as "voice information") comprises a voice ID (identification information) rather than tone source waveform data themselves. Various tone source waveform data themselves (i.e., substance of the tone source waveform data) are recorded in the voice information memory 30*c* that is one area within the non-volatile memory 30, and a stored location (address), within the voice information memory 30*c*, of any one of the tone source waveforms is identified by the voice ID. In FIG. 2A, for convenience sake, "V" is used as a reference character indicating a voice ID, and a value of the voice ID is indicated by a one-digit suffix added to the reference character "V". For example, a voice ID value $V_1$ identifies a tone source waveform different from a tone source waveform identified by a voice ID value $V_4$. However, in a case where the same voice ID $V_1$ is set for different performance parts, the same tone source waveform is designated (used) for these different performance parts.

The condition information comprises a plurality of types of parameters (A-N) capable of defining a tone generation or control style; more specifically, the condition information comprises substantive values representing the parameters A-N. Here, the parameters A-N are parameters intended to set or change a tone generation or control style, such as parameters for setting or controlling various effects like vibrato, reverberation and pan effects, and a degree of any of various effects, such as vibrato, loudness of a tone, etc. are set in accordance with values of these parameters. In FIG. 2A, for convenience sake, "A"-"N" are used as reference characters for identifying respective types of the parameters constituting the condition information, and a substantive value of each type of parameter is indicated by a two-digit suffix added to the reference character "A"-"N". For example, a parameter value indicated by a reference character $A_{11}$ of the parameter A shows that the parameter value is the same among different performance parts and/or regists.

Note that the information (voice information) indicative of the tone source waveform identified by the voice ID is waveform information for reproducing a tone corresponding to any one of various tone sources (tone colors). The condition information, on the other hand, is information indicative of substantive values of various parameters. Thus, the voice information that is waveform information is greater in data quantity than the condition information that is value information of parameters. Thus, in the instant embodiment, the storage area of the tone setting information memory 30*a* is constructed to contain voice IDs for referencing information (voice information) indicative of tone source waveforms, without including the information (voice information) indicative of tone source waveforms.

Figure 2B:
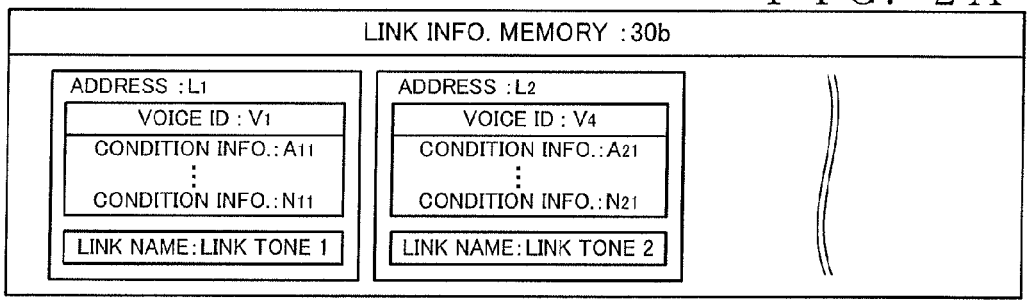
FIG. 2B is an example construction of a link information memory.
Figure 2C:
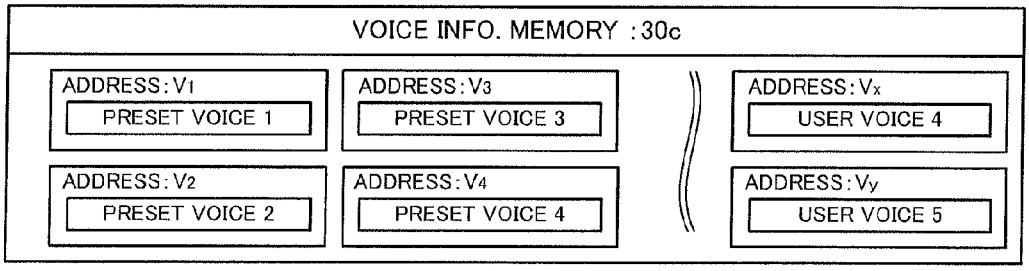
FIG. 2C is an example construction of a voice information memory.

Substantive data of the information (voice information) indicative of tone source waveforms are stored in the voice information memory 30*c*. FIG. 2C schematically shows a construction of the voice information memory 30*c*, which more particularly shows correspondence between various values $V_1$-$V_4$ of voice IDs (voice ID values $V_1$-$V_4$) and substantive data of voice information corresponding thereto. In FIG. 2C, "address" sections each indicate an address of a storage location where substantive data of any one of various voice information are stored, and these addresses are associated with values $V_1$-$V_y$ of various voice IDs. "preset voice 1", "preset voice 2", etc. indicated in association with the address sections are indicative of names of the substantive data of the voice information stored in the addresses, and the respective substantive data (e.g., waveform data) of the voice information given these names are stored in the voice information memory 30*c* together with name data indicative of the names. In the instant embodiment, both predefined voice information and user-defined information is usable; the predefined voice information will be referred to as "preset voice" while the user-defined information will be referred to as "user voice".

In the instant embodiment, a link ID (identification information) is stored in the tone setting information memory 30*a* for each set of tone setting information PR in association with the set, as shown in FIG. 2A. The "link" proposed in connection with the instant embodiment is a concept that setting states or settings of tone setting parameters (voice ID and condition information) are caused to match (i.e., made the same or interlocked) between a plurality of sets of tone setting information PR assigned (or having set therefor) a same link ID. Thus, a plurality of different "links" can exist in accordance with the number of different link IDs. Further, as will be described later, settings of such links can be newly made, changed and canceled as desired. In the illustrated example of FIG. 2A, for convenience sake, "L" is used as a reference character indicating a link ID, and a value of each such link ID is indicated by a one-digit suffix added to the reference character "L". Thus, a common or same link is set for a plurality of sets of tone setting information PR (e.g., $PR_{11}$, $PR_{m1}$, $R_{12}$) having a same link ID value (e.g., $L_1$), and settings of tone setting parameters (voice ID and condition information) are the same among the plurality of sets of tone setting information PR.

As an example, the link information memory 30*b* is provided for allowing the user to promptly reference, for each link identified by a link ID, settings of tone setting parameters (voice ID and condition information) in the link. FIG. 2B is a diagram showing a construction of the link information memory 30*b*, in which are stored, in association with link ID values $L_1$, $L_2$, . . . , settings (values) of the tone setting parameters (voice ID and condition information) in sets of tone setting information as well as data indicative of names assigned to the links. Each "address" section in FIG. 2B indicates an address of a storage location where is stored the corresponding set of tone setting parameters (voice ID and condition information) identified by the link ID, and such addresses are associated with link ID values $L_1$, $L_2$, . . . . The settings (setting values) of the tone setting parameters (voice ID and condition information) in a given set of tone setting information stored in association with any one of various link ID values $L_1$, $L_2$, . . . are the same as those of the tone setting parameters (voice ID and condition information) in a set of tone setting information stored in the tone setting information memory 30*a* and having a link ID of the same value as the link ID of the given set. Note that the link names may be managed in a storage area (such as a table) separate from the link information memory 30*b*.

Further, in the instant embodiment, the user can give an instruction for using any one of the n sets of regist data by operating the input/output section 60 at desired timing during a performance. In accordance with such a user's instruction, the instructed one set of regist data is read out from the tone setting information memory (regist memory) 30*a* and then set so that it can be used in the electronic musical instrument 10 for a subsequent tone performance. Namely, once the performance operator unit 50 is operated following the user's instruction, the CPU 20 acquires, from the instructed one set of regist data, one set of tone setting information corresponding to an operated part of the performance operator unit 50, and then the CPU 50 instructs the tone generation/output section 70 to generate a tone corresponding to the operation on the performance operator unit 50 with tone settings indicated by the one set of tone setting information.

In the aforementioned construction, the electronic musical instrument 10 functions as a tone setting information setting/editing apparatus by the CPU 20 executing a not-shown tone setting information setting/editing program. More specifically, the tone setting information setting/editing program includes a link setting section, a tone setting information editing section and an edited content reflection section. The CPU 20 performs a function for editing tone setting information PR by means of the tone setting information editing section. Namely, the CPU 20 displays a regist selection screen on the input/output section 60 and receives a selection of a regist. Once the user selects a set of regist on the input/output section 60, the CPU 20 identifies, as an object of editing, a plurality of sets of tone setting information PR (for a plurality of performance parts) of the selected set of regist. Once the regist as the object of editing (object-of-editing regist) is identified, the CPU 20 acquires, from the tone setting information memory 30*a* within the non-volatile memory 30, tone setting information PR for all performance parts (parts) of the selected regist and records the acquired tone setting information PR into a current memory area 40*a* of the RAM 40. The current memory area 40*a* is a recording area provided in the RAM 40 for retaining tone setting information PR with edited content sequentially reflected therein. The current memory area 40*a* will hereinafter also be referred to simply as "current area 40*a*".

Further, the CPU 20 displays a part selection screen on the input/output section 60 to receive a selection of a performance part. Once the user selects a performance part on the input/output section 60, the CPU 20 identifies, as an object of editing (object-of-editing part), tone setting information PR of the selected performance part from the one set of regist data buffered in the current area 40. Then, the CPU 20 displays, on the input/output section 60, an editing screen (user interface or UI screen) for editing the tone setting information PR, receives a user's operation performed on the input/output section 60 and performs editing processing corresponding to the received operation. Namely, once the user performs an editing operation on the editing screen, the CPU 20 modifies the tone setting information PR (tone setting parameters) of the object-of-editing part recorded in the current area 40*a*.

FIGS. 1B to 1E are diagrams showing examples of the editing screen, and these editing screens are each a screen displayed with one object-of-editing part identified. More specifically, FIGS. 1B to 1E illustratively show screens displayed when part 1 of a given set of regist data has been selected as an object of editing. The following description will be given assuming that that tone setting information PR of part 1 of regist 1 is an object of editing.

Figure 1B:
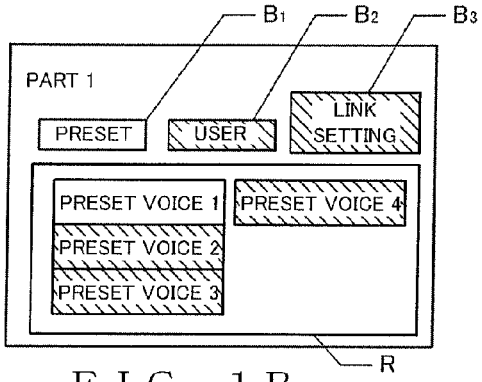
FIGS. 1B to 1E are diagrams showing editing screens.
Figure 1C:
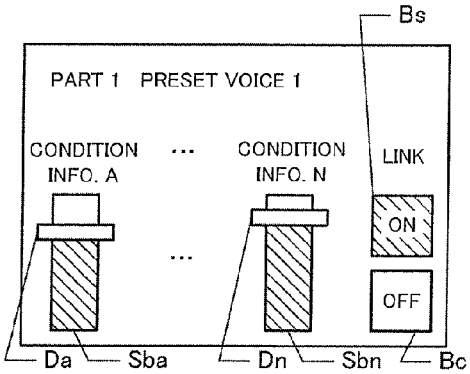
Figure 1D:
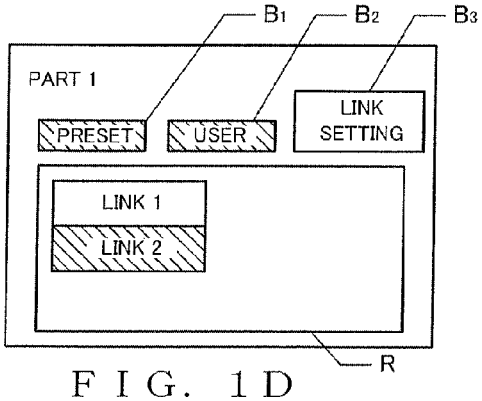

FIGS. 1B and 1D illustrate an editing screen for selecting a voice (tone color) to be allocated to the current object-of-editing part (i.e., voice selecting UI screen or voice selecting screen). A voice (tone color) selection may be performed here by selecting a desired voice from among a plurality of preset voices and user voices as heretofore known in the art; this is a scheme of selecting a desired voice (tone color) directly. Further, in the instant embodiment, a desired voice (tone color) can be selected indirectly by selecting a desired link from among one or more existing links. In such a case, a voice (tone color) identified by a voice ID in a set of tone setting information pertaining to the selected link. Namely, buttons $B_1$-$B_3$ for selecting any one of types, i.e. preset voice, user voice and existing link, are displayed on the voice selecting screen shown in FIGS. 1B and 1D. Once any one of the buttons $B_1$-$B_3$ is selected, the CPU 20 identifies an option corresponding to the selected button and displays the option on a display region R by controlling the input/output section 60.

For example, if the button $B_1$ for selecting a preset voice has been selected, the CPU 20 references the voice information memory 30*c* within the non-volatile memory 30 to identify all voice information recorded as preset voices and reads out the respective name data of these preset voices. Then, the CPU 20 displays the names of all of the preset voices as options on the display region R, as illustratively shown in FIG. 1B as preset voice 1, preset voice 2, etc. If the button $B_2$ for selecting a user voice has been selected, the CPU 20 references the voice information memory 30*c* within the non-volatile memory 30 to identify all voice information recorded as user voices and reads out the respective name data of these user voices. Then, the CPU 20 displays the names (user voice 1, user voice 2, etc.) of all of the preset voices as options on the display region R. The preset voice options and the user voice options are tone source options because they are options for designating tone sources.

Further, if the button $B_3$ for selecting any one of existing links has been selected, the CPU 20 references the link information memory 30*b* within the non-volatile memory 30 to read out the respective name data of all links currently registered in the link information memory 30*b* (i.e., exiting links). Then, the CPU 20 displays the names of all of the existing links as options on the display region R, as illustratively shown in FIG. 1D as link tone 1, link tone 2, etc. These options are options for selecting an existing link. Hollow rectangular blocks in FIGS. 1B and 1D indicate selected buttons and selected options, and hatched rectangular blocks indicate non-selected buttons and non-selected options. When no voice or link has been selected yet, all the options are displayed in hatched rectangular blocks on the display region R. Once any voice or link option is selected, the selected option is changed to a hollow rectangular block. Further, if another voice or link option has been selected with some voice or link option selected, the latest selected option is changed to a hollow rectangular block while the previously selected option is changed to a hatched rectangular block.

Once preset voice 1 is newly selected as shown in FIG. 1B, the CPU 20 writes a value $V_1$, indicative of preset voice 1, as a voice ID value in a set of tone setting information PR for the current object-of-editing part stored in the current area 40*a*. In this manner, voice (tone color) selection or editing is performed for the current object-of-editing part. If a new voice (tone color) has been selected for the current object-of-editing part, the CPU 20 writes a plurality of default parameter values as condition information for the current object-of-editing part stored in the current area 40*a*. As will be described later, the condition information for the current object-of-editing part may be retained at so-far-retained values without being updated with the default parameter values. Then, these condition information can be edited as necessary.

Once an instruction for editing condition information is given, the CPU 20 controls the input/output section 60 to display parameter values of the condition information in an editable fashion. FIG. 1C is an example of the editing screen where the parameter values are displayed in an editable manner. More specifically, in FIG. 1C, that the parameter types A-N in the condition information are objects of editing is indicated by letters etc., and images of slide bars Sba and Sbn operable by the user to change the parameter values are displayed beneath the letters. The slide bars Sba and Sbn are capable of changing the corresponding parameter values by their respective slide knobs Da and Dn being moved vertically (in an up-down direction) through user's touch operations. Desired values can be selected from value ranges indicated by respective vertical lengths of the slide bars Sba and Sbn. Namely, a UI is constructed such that hatched blocks from the respective lower ends of the slide bars Sba and Sbn to the slide knobs Da and Dn show parameter values. On the basis of signals given from the input/output section 60, the CPU 20 receives user's operations on the slide bars Sba and Sbn and thereby receives results of editing of the parameter values. In the illustrated example of FIG. 1C, that the tone source is set at preset voice 1 in part 1 of regist 1 that is the object-of-editing part is indicated by letters. Further, for simplicity, specific examples are shown in FIG. 1C only for parameters A and N.

The instant embodiment, capable of performing the above-described editing, is constructed to be capable of readily collectively editing a plurality of tone setting information by the tone setting information setting/editing program causing the CPU 20 to perform processing based on the link setting section and the edited content reflection section. In the instant embodiment, the user can newly set a link for currently-edited tone setting information PR, by instructing setting of a link during the course of editing of condition information. Also, the user can perform link setting such that the currently-edited tone setting information PR is incorporated into any one of existing links, by selecting an option of the one existing link.

Figure 1E:
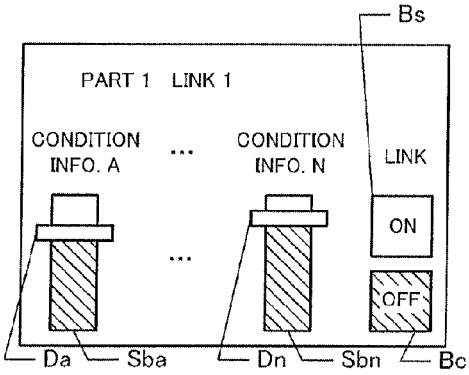

More specifically, an ON button Bs for validating setting of a link and an OFF button for invalidating or canceling setting of a link are provided on the condition information editing screen, as shown in FIGS. 1C and 1E. In FIGS. 1C and 1E, a selected state of the buttons Bs and Bc is indicated by a hollow block, and a non-selected state of the buttons Bs and Bc is indicated by a hatched block. Once the ON button Bs is selected when the button Bs is in the non-selected (link-off) state, the CPU 20 receives a new link creation instruction for setting a new link. In this case, the CPU 20 references the link information memory 30*b* to select an empty region from a storage area of the link information memory 30*b* and records the voice ID and condition information, stored in the current area 40*a*, into the selected empty region. Namely, the same one set of tone setting information as the currently edited tone setting information is stored into the link information memory 30*b* of the non-volatile memory 30. At that time, the CPU 20 automatically assigns a new link ID and link name to the one set of tone setting information newly recorded into the link information memory 30*b*. Then, the link ID automatically assigned to the new link is associated with an address indicative of a recorded position, within the link information memory 30*b*, of the one set of tone setting information corresponding to the new link (link-set one set of tone setting information), so that reference (access) can be made to link information (the link-set one set of tone setting information) within the link information memory 30*b* by use of the link ID. Note that the instant embodiment may be constructed to allow the user to input a desired link name by operating the input/output section 60.

Further, the CPU 20 stores the link ID, automatically assigned to the new link, into the current area 40*a* in association with the currently-edited set of tone setting information PR. In this manner, a new link can be set for the set of tone setting information PR of the object-of-editing part. Upon completion of the editing performed as necessary on the tone setting information PR of the object-of-editing part, the set of tone setting information PR recorded at the address, within the link information memory 30*b*, indicated by the link ID is updated with the set of tone setting information PR recorded in the current area 40*a*. If the link-off state is left maintained as shown in FIG. 1C, the link ID corresponding to the set of tone setting information PR recorded in the current area 40*a* is OFF (indicating that no link is set). For example, "link ID: OFF" displayed in FIG. 2A indicates that no link is set for the part in question.

An operation for incorporating one set of tone setting information PR of the current object-of-editing part into an existing link is performed on the editing screen shown in FIG. 1D. Once link tone 1 is selected on the editing screen as shown in FIG. 1D, the CPU 20 identifies a link ID of link tone 1, references the link information memory 30*b* by use of the link ID to retrieve from the link information memory 30*b* one set of tone setting information PR corresponding to the link ID of the selected link tone 1, and then writes into the current area 40*a* the retrieved set of tone setting information PR as a set of tone setting information PR of the object-of-editing part. Link tone 1 comprises link information stored at an address corresponding to the link ID value $L_1$ in the illustrated example of FIG. 2B. Thus, in this example, one set of tone setting information PR, including a voice ID value $V_1$ and condition information comprising parameters $A_{11}$-$N_{11}$, is written into the object-of-editing part of the current area 40*a*.

Further, the CPU 20 associates the link ID ($L_1$) of selected link tone 1 with the set of tone setting information PR of the object-of-editing part stored in the current area 40*a*. Namely, when a condition information editing instruction has been given in a link set state, it is possible to edit the condition information on the editing screen of FIG. 1E in generally the same manner as in FIG. 1C. As will be described in detail later, once condition information is edited on the editing screen of FIG. 1E, not only the set of tone setting information PR of the object-of-editing part stored in the current area 40*a*, but also the same edited content will be reflected sooner or later in one or more other sets of tone setting information PR linked to the condition information. The user can switch between the aforementioned editing screens by means of a not-shown switch button and terminate or end the editing by means of an editing end button.

Further, once an editing end instruction is given on any one of the editing screens shown in any one of FIGS. 1B-1E in the instant embodiment, the CPU 20 records, into the tone setting information of the non-volatile memory 30, the set of regist data (a plurality of sets of tone setting information PR) stored in the current area 40*a*. Further, once a given set of tone setting information PR having a link set therefor is edited, the CPU 20 performs a link reflection process at appropriate timing such that the same edited content is reflected in one or more other sets of tone setting information PR linked to that given set of tone setting information PR. For example, when editing of a given set of tone setting information PR having a given link set therefor has ended, the CPU 20 may search through all regist data stored in the tone setting information memory 30*a* for all performance parts having the same link ID as the link ID of the given link (note, however, that a performance part for which editing has been ended just now may be excluded from objects of the search) and update a recording of each of all searched-out sets of tone setting information PR within the tone setting information memory 30*a*, having the same link ID as the link ID of the given link, so that the recording matches settings of tone setting parameters in the set of tone setting information PR having the link ID and stored in the tone setting information memory 30*a*. In this manner, the link reflection process is performed, substantially simultaneously with the end of the editing, so that the settings of the tone setting parameters match between one or more sets of tone setting information PR having the same link ID as the link ID associated with the edited one set of tone setting information PR.

As another example, a necessary link reflection process may be performed, in place of the aforementioned link reflection process immediately following the end of the editing, at appropriate timing within a period from the end of the editing to immediately before the edited tone setting information is used for tone reproduction. For example, when desired regist data to be used for tone reproduction is selected and written into the current area 40*a*, and if tone setting information PR of one or more of a plurality of parts included in the selected regist data have valid link IDs (i.e., link IDs other than the link-off), one or more sets of tone setting information PR corresponding to one more links that correspond to the valid link IDs may be read out from the link information memory 30*b*, and each of sets of tone setting information PR having the corresponding link IDs within the regist data stored in the tone setting information memory 30*a* may be updated with the read-out tone setting information PR. Into the current area 40*a* is written the regist data having been subjected to such a link reflection process. In this manner, the link reflection process is performed, at appropriate timing within a period from the end of the editing to immediately before the edited tone setting information is used for tone reproduction, so that the settings of the tone setting parameters match between the one or more sets of tone setting information PR having the same link ID as the link ID associated with the edited set of tone setting information PR.

As still another example, when a desired set of regist data is to be selected and written into the current area 40*a* so as to be used for tone reproduction, the set of regist data is retrieved from the tone setting information memory 30*a* and temporarily written into the current area 40*a*. Then, if tone setting information PR of one or more of a plurality of performance parts included in the selected regist data have valid link IDs (i.e., link IDs other than the link-off), one or more sets of tone setting information PR corresponding to one more links that correspond to the valid link IDs may be read out from the link information memory 30*b*, and content of each of sets of tone setting information PR, recorded in the current area 40*a*, having the corresponding link IDs may be updated with the read-out tone setting information PR. In this manner too, the link reflection process can be performed, at appropriate timing till immediately before the edited tone setting information is used for tone reproduction, so that the setting of any one of the tone setting parameters matches between the one or more sets of tone setting information having the same link ID as the link ID associated with the edited one set of tone setting information PR.

According to the above-described construction, in a case where a common or same link is set for a plurality of sets of tone setting information PR, and if any one of the plurality of sets of tone setting information PR having the same link set therefore has been edited, the same edited content is reflected in the other sets of tone setting information PR having the same link. Thus, once a link is set via a common or same link ID, editing performed on a given set of tone setting information PR can be automatically reflected in the other sets of tone setting information PR linked to the given set of tone setting information PR. Also, a link is set for each set of tone setting information PR. Thus, in the link reflection performed in the instant embodiment, edited content in a given set of tone setting information is reflected in the other sets of tone setting information PR linked to the given set, with no regard to which of parameters A-N of condition information have been edited and which of the parameters A-N have not been edited, as long as at least one of the parameters A-N has been edited. Therefore, even where modification of the same set of tone setting information PR is repeated, one or more other sets of tone setting information linked to the modified or edited set of tone setting information can be readily collectively modified. Further, because the instant embodiment can prevent the user from making a mistake of forgetting to select a performance part and regist data that are to be subjected to collective editing at the time of each modification as made in the prior art, the instant embodiment can facilitate ending the editing in a normal or appropriate manner.

(2) Editing Processing (2-1) Voice Selection/Link Setting Processing

Figure 3:
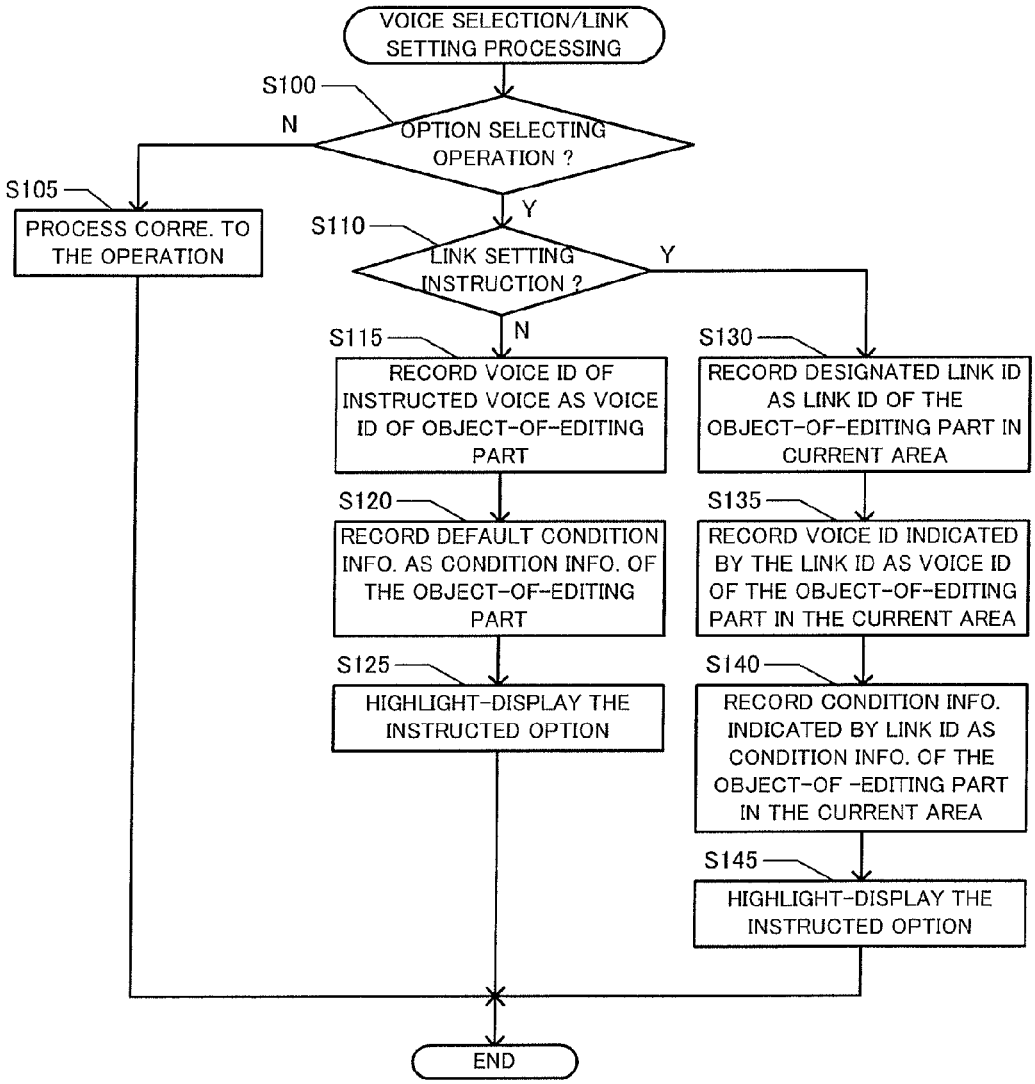
FIG. 3 is a flow chart of voice selection/link setting processing.

Next, the editing processing executed by the editing program in the instant embodiment will be described, starting with voice section/link setting processing. The voice selection/link setting processing is performed by the CPU 20 with a regist and a performance part designated as objects of editing. The CPU 20 performs the voice selection/link setting processing of FIG. 3 with a plurality of sets of tone setting information PR included in the object-of-editing set of regist data recorded into the current area 40*a*, and with the editing screen of the one object-of-editing part as shown in FIGS. 1B and 1D (including options on the display region R) displayed on the input/output section 60.

Namely, in the voice selection/link processing, the CPU 20 determines whether an operation performed by the user is an option selecting operation (step S100). Namely, the CPU 20 determines whether the operation performed by the user via the input/output section 60 is an operation for selecting any one of tone source options or link options displayed on the display region R. If the operation performed by the user is not an option selecting operation as determined at step S100, the CPU 20 performs a process corresponding to the operation performed by the user (step S105). The operation in response to which the process is performed at step S105 only needs to be other than an option selecting operation, and examples of the process to be performed at step S105 in response to the non-option-selecting operation include a process for switching between highlight display and grayed-out display and between options on the display area R in response to an operation of any one of the buttons $B_1$-$B_3$, a process for switching to the condition information editing screen, and a process for receiving an editing end instruction, etc.

If the operation performed by the user is an option selecting operation as determined at step S100, the CPU 20 further determines whether or not the selected option is a link option for giving a link setting instruction to instruct setting of a link by selecting an existing link (step S110). If the selected option is not a link option for giving a link setting instruction as determined at step S110, it means that the selected option is a tone source option, and thus, the CPU 20 records a voice ID of a voice instructed by the option as a voice ID of the object-of-editing part recorded in the current area 40*a* (step S115).

Then, the CPU 20 records predetermined default values of individual parameters A-N of condition information as condition information of the object-of-editing part recorded in the current area 40*a* (step S120). As a consequence, current values of the condition information of one set of tone setting information PR of the object-of-editing part are set at the predetermined default values. Then, the CPU 20 highlight-displays the instructed option (step S125). Namely, the CPU 20 controls the input/output section 60 to highlight-display the option determined to have been selected at step S110 and gray-out the other options. In this manner, the name of the selected voice is clearly displayed.

If the operation performed by the user is an option for giving a link selecting operation as determined at step S100, the CPU 20 records a link ID of an existing ID selected by the option as a link ID of the object-of-editing part recorded in the current area 40*a* (step S130). In this manner, the link ID is stored in association with the set of tone setting information PR of the object-of-editing part recorded in the current area 40*a*. Further, the CPU 20 references the link information memory 30*b* by use of the link ID, identifies an address where is recorded tone setting information PR of the existing link corresponding to the selected link option and reads out the tone setting information PR of the existing link to the current area 40*a*. In this way, the set of tone setting information PR of the object-of-editing part is incorporated into the existing link.

Then, the CPU 20 records the voice ID indicated by the link ID as a voice ID of the object-of-editing part recorded in the current area 40*a* (step S135). Namely, the CPU 20 acquires the voice ID of the selected existing link from the address of the link information memory 30*b* indicated by the link ID of the existing link corresponding to the selected link option, and it records the acquired voice ID into the current area 40*a* as the voice ID of the object-of-editing part.

Then, the CPU 20 records the condition information indicated by the link ID as condition information of the object-of-editing part recorded in the current area 40*a* (step S140). Namely, the CPU 20 acquires the condition information of the selected existing link from the address of the link information memory 30*b* indicated by the link ID of the existing link corresponding to the selected link option and then updates, with the acquired condition information, the condition information in the set of tone setting information PR of the object-of-editing part. As a consequence, the voice of the tone setting information PR of the object-of-editing part and the current values of the condition information are placed in a synchronized state with the selected existing link. Then, the CPU 20 highlight-displays the instructed option (step S145). In this manner, the name of the selected voice is clearly displayed. As described above, the CPU 20 is constructed to cause settings of the tone setting parameters in the selected set of tone setting information to match the tone setting parameters in the other sets of tone setting information having the same link ID as the link ID of the selected link.

In the instant embodiment, as described above, if a tone source option has been selected on the editing screen shown in FIG. 1B or 1D, a voice of the object-of-editing part is set as desired by the user, but also condition information of the object-of-editing part is set at the default values. If, on the other hand, a link option has been selected, a voice, condition information and link ID of the object-of-editing par are set as designated by the selected existing link. Thus, although the object of selection differs between the voice option and the link option, the two options are displayed on the display regions R of a same layout (FIGS. 1B and 1D) and selected through similar operations; besides, the condition information editing screens displayed after selection of the two options are also the same as each other (FIGS. 1C and 1E). Thus, the user can perform editing without paying particular attention to a difference between selections by the two options. Namely, for editing of one set of tone setting information, the CPU 20 is constructed to: present a single user interface screen on the display device (FIGS. 1B and 1D) so that the user can select any one of a plurality of predefined voices and select any one of a plurality of already-set links on the single user interface screen; in response to selection of any one of the plurality of predefined voices, display tone setting parameters for controlling the selected voice to thereby permit editing of the displayed tone setting parameters in accordance with user operations (FIG. 1C); and, in response to selection of any one of the plurality of already-set links, display one or more tone setting parameters included in a set of tone setting information corresponding to the selected link to thereby permit editing of any of the displayed tone setting parameters in accordance with user operations (FIG. 1E).

(2-2) Condition Editing Processing

Figure 4:
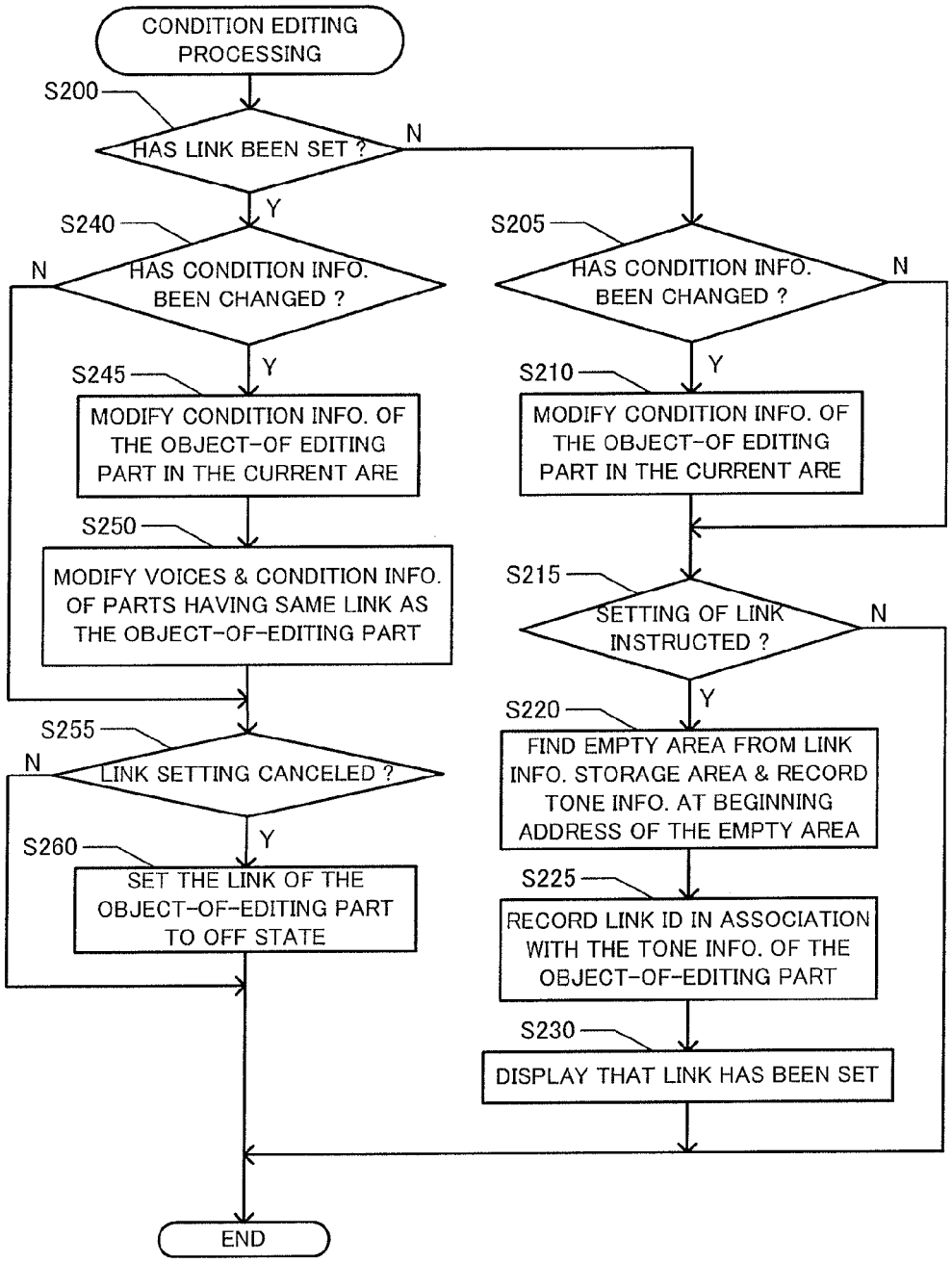
FIG. 4 is a flow chart of condition editing processing.

Once a condition information editing instruction is given after a voice has been selected on the editing screen shown in FIG. 1B or after a link has been selected on the editing screen shown in FIG. 1D, a process for switching to the condition information editing screen is performed at step S105. In this case, the CPU 20 performs condition editing processing shown in FIG. 4. In the condition editing processing, the CPU 20 determines whether any link has been set in the tone setting information PR of the current object-of-editing part (step S200). Namely, if a link ID is currently associated with the set of tone setting information PR of the object-of-editing part, the CPU 20 determines that a link has already been set for the set of tone setting information PR.

If no link ID is currently associated with the tone setting information PR of the current object-of-editing part as determined at step S200, the CPU 20 further determines whether the condition information has been changed (step S205), by determining, on the basis of signals from the input/output section 60, whether an operation has been performed on any of the slide knobs Da and Dn shown in FIG. 1C.

If the condition information has been changed as determined at step S205, the CPU 20 modifies the condition information of the object-of-editing part recorded in the current area 40*a* (step S210). Namely, the CPU 20 identifies edited parameter values of individual parameters A-N of the condition information on the basis of operated amounts of the slide knobs Da and Dn and then modifies the condition information of the object-of-editing part in the current area 40*a* with the identified parameter values. If the condition information has been changed as determined at step S205, the CPU 20 skips step S210.

Then, the CPU 20 determines whether an instruction for setting a new link has been given (step S215). Namely, if the ON button Bs shown in FIG. 1C has been selected, the CPU 20 determines that an instruction for setting a new link has been given. If setting of a new link has been instructed as determined at step S215, the CPU 20 finds an empty region from the storage area of the link information memory 30*b* in the non-volatile memory 30 and sends, to the beginning address of the empty region, the set of tone setting information PR (current values being edited values) of the current object-of-editing part recorded in the current area 40*a* for storage in the empty region (step S220).

Then, the CPU 20 determines a link ID of the new link and records the determined link ID in association with the set of tone setting information PR of the current object-of-editing part recorded in the current area 40*a* (step S225). For example, the CPU 20 determines, as the link ID, the beginning address of the region where the set of tone setting information PR (current values being edited) has been recorded at step S220 above and stores the determined link ID in association with the set of tone setting information PR of the current object-of-editing part recorded in the current area 40*a*. As a result of the above operations, a new link is set in association with the set of tone setting information PR of the current object-of-editing part, and the set of tone setting information PR (voice ID and condition information) corresponding to the new link is recorded into the link information memory 30*b*. In this case, the CPU 20 controls the input/output section 60 to display on the editing screen information that the new link has been set (such as a guide indicative of the name of the link) (step S230). If setting of a new link has not been instructed as determined at step S215, the CPU 20 skips steps S220-S230. Note that, immediately after such a new list link has been set, there is no other performance part linking to the new link. After that, however, a plurality of parts (a plurality of sets of tone setting information PR) will have the same link ID as the new link in response to subsequent selection of an existing link as shown in FIG. 1D.

If, on the other hand, any link ID has already been associated with the tone setting information PR of the current object-of-editing part as determined at step S200, the CPU 20 further determines whether the condition information has been changed (step S240). If the condition information has been changed as determined at step S240, the CPU 20 modifies the condition information of the object-of-editing part in the current area 40*a* (step S245). Note that the operations at step S240 and step S245 are similar to the operations at step S205 and step S210. Note, however, that, if the condition information has not been changed as determined at step S240, the CPU 20 skips steps S245 and S250.

Once the condition information of the object-of-editing part in the current area 40*a* is modified at step S245, the CPU 20 modifies voices and condition information of all parts having set therefor the same link as the object-of-editing part in the current area 40*a* so as to assume the same settings as the voice and condition information of the object-of-editing part (step S250); namely, a link reflection process is performed at step S250. Namely, in a case where the current area 40*a* has recorded therein tone setting information PR of all parts (part 1-part m) of an object-of-editing regist, and where a particular one of the parts is the object-of-editing part (part 1 in FIGS. 1B-1E), it is possible that the same link as the object-of-editing part is set for any other performance part than the object-of-editing part. In such a case, the CPU 20 in the instant embodiment modifies the tone setting information PR of the other part, having set therefore the same link as the object-of-editing part, during the course of editing of the object-of-editing part (i.e., the link reflection process is performed). Thus, the CPU 20 determines whether any other part having the same ling ID as the object-of-editing part is present in the current area 40*a*, and if any such other part is present in the current area 40*a*, the CPU 20 modifies the recording in the current area 40*a* so that the tone setting information PR of the other part has the same voice and condition information as the tone setting information PR of the object-of-editing part.

In the illustrated example of FIG. 2A, assuming that part 1 of regist 1 is the object-of-editing part, the same link ID ($L_1$) as part 1 is also associated with part m. In this case, once the condition information of part 1 is modified, the condition information of part m too is modified in response to (in interlocked relation to) the modification of the condition information of part 1. Namely, because a plurality of parts in the same regist are used at the same time, the instant embodiment is constructed to cause editing of the object-of-editing part to be reflected in the other parts during the editing of the object-of-editing part, to thereby cause the condition information of the object-of-editing part to be reflected in the other parts in real time.

Then, the CPU 20 determines whether or not setting of any link has been canceled (step S255). Namely, if the OFF button Bc shown in FIG. 1D has been selected, the CPU 20 determines that a link set for the object-of-editing part has been canceled. If setting of any link has been canceled as determined at step S255, the CPU 20 sets the link ID of the tone setting information PR of the object-of-editing part in the current area 40*a* to the OFF state (step S260). Namely, the CPU 20 deletes the link ID of the tone setting information PR of the object-of-editing part in the current area 40*a*. Because the instant embodiment can cancel the link (permit removal from the link) by merely deleting the link ID associated with the tone setting information PR of the object-of-editing part as noted above, it can readily cancel the link setting without influencing the link setting of the other parts having the same link ID as the canceled link ID and without influencing storage, in the link information memory 30*b*, of link information corresponding to the canceled link ID. If setting of any link has not been canceled as determined at step S255, the CPU 20 skips step S260.

(3) Edited Content Reflection Processing

In a case where one set of tone setting information PR in the current area has been edited through the editing processing and has a link ID associated therewith, one set of tone setting information PR having the same link ID in the link information memory 30*b* is updated with the edited content. Further, as noted above, by the link information memory 30*b* being referenced immediately after the editing or at appropriate timing within a period from the end of the editing to immediately before the edited tone setting information is used for tone reproduction, the edited content is reflected in one or more other sets of tone setting information PR having the same ID as the edited link ID in the tone setting information memory 30*a*.

(3-1) Updating of the Link Information Memory 30*b*

Once an end instruction is given for ending the editing on the set of tone setting information PR of the object-of-editing part recorded in the current area 40*a*, and if a link ID is currently associated with the edited set of tone setting information PR, content of the set of tone setting information PR recorded in the current area 40*a* is recorded into the address, indicated by the link ID, of the link information memory 30*b* of the non-volatile memory 30, so that the content of the set of tone setting information PR can be used as link information. With the link information recorded in the link information memory 30*b* of the non-volatile memory 30 like this, the content of the tone setting information PR of the same link ID in the link information memory 30*b* can be reflected in all sets of tone setting information PR assigned (having set therefor) the same link ID.

(3-2) Reflection in Link-set Tone Setting Information PR

If any tone setting information PR having the same link set therefor is present within a regist that is not an object of editing, it suffices that content of tone setting information PR of the link stored in the ling information memory 30*b* be reflected in tone setting information PR recorded in the tone setting information memory 30*a* at desired timing before the tone setting information PR is used for a performance. For example, the instant embodiment may be constructed in such a manner that, when a regist is to be used for a performance or to be edited (to be made an object of editing), the CPU 20 determines whether there is any tone setting information PR having a link ID associated therewith in the regist. In this case, if there is such tone setting information PR in the regist, the CPU 20 acquires, from the link information memory 30*b*, link information (tone setting information PR) indicated by the link ID, with which it updates stored content, in the tone setting information memory 30*a*, of tone setting information PR of a part associated with the link ID in the regist. Namely, when reading out a set of regist data to be used for a performance to the current area 40*a*, the CPU 20 updates, with stored content in the link information memory 30*b*, tone setting information PR of all performance parts associated with the link ID in the set of regist data, reads out the edited set of regist data from the tone setting information memory 30*a* and then writes the read-out edited set of regist data into the current area 40*a*. As a modification, when reading out a set of regist data to be used for a performance (or to be edited) to the current area 40*a*, the CPU 20 may read out the set of regist data from the setting information memory 30*a*, write the read-out set of regist data into the current area 40*a* and then update, with stored content in the link information memory 30*b*, tone setting information PR of all performance parts associated with the link ID in the set of regist data written in the current area 40*a*. In the latter case, although the regist data in the tone setting information memory 30*a* are not updated with the stored content in the link information memory 30*b*, no problem would arise because necessary updating is performed on the current area 40*a* with reference to the stored content in the link information memory 30*b* as the regist data are written into the current area 40*a* for subsequent use. As noted above, the CPU 20 is constructed to cause settings of tone setting parameters to match between or among a plurality of tone setting information PR having the same link ID, by referencing the link information memory 30*b* on the basis of the link ID.

Needless to say, link-set tone setting information PR may be searched for from all regists in the tone setting information memory 30*a* at the time of the end of editing of an object of editing so that edited content is reflected in all of the searched-out tone setting information PR. With such a construction, it is possible to enhance the general versatility of the tone setting information memory 30*a*. Note that, even in a case where recorded content in the tone setting information memory 30*a* is retrieved by being copied into a removable recording medium and then used in an electronic musical instrument having no link setting function, all tone setting information PR having the same link ID set therefor can be used with the same settings. Of course, various timing is assumable as timing at which edited content of the tone setting information PR in the current area 40*a* is reflected in the tone setting information memory 30*a* of the non-volatile memory 30. In such a case, each time editing is performed for an object-of-editing part having a link ID associated therewith, the edited content may be stored (reflected) as tone setting information PR of one or more performance parts of any other regist having the same link ID associated therewith in the tone setting information memory 30*a* of the non-volatile memory 30. In this case, there is no need to provide the link information memory 30*b* for storing the tone setting information PR associated with the link ID edited in the current area 40*a*. It is not necessary to provide a dedicated link information memory 30*b* if there is provided a mechanism for determining a plurality of sets of tone setting information PR having a same link set therefor, a mechanism for searching for tone setting information PR having a same link ID from the tone setting information memory 30*a*, etc. Alternatively, a function equivalent to the link information memory 30*b* may be realized by using content (tone setting information PR and link ID) of an appropriate performance part recorded in the tone setting information memory 30*a*.

In the case where the link information memory 30*b* is not provided, upon end of editing of an object-of-editing part having associated therewith a link ID pertaining to a set of regist data, the instant embodiment may be constructed in such a manner that the edited content is reflected only in (recorded only for) a set of tone setting information PR of the performance part in the set of regist data recorded in the tone setting information memory 30*a*. In such a case, an address in the tone setting information memory 30*a* where the recorded (latest) set of tone setting information PR is recorded may be separately stored together with the link ID, and tone setting information PR of one or more parts associated with the same link ID in the tone setting information memory 30*a* may be used after being updated with the recorded (latest) set of tone setting information PR (i.e., the recorded (latest) set of tone setting information PR is reflected in the tone setting information PR of one or more performance parts associated with the same link ID) on the basis of the stored address and link ID.

(4) Other Embodiments

The above-described embodiment is a mere illustrative embodiment for practicing the present invention, and various other embodiments are also possible. For example, setting and cancellation of a link may be performed during the course of a user operation other than tone setting information editing work. Further, the electronic musical instrument 10 too is not limited to the above-described construction and may be constructed to acquire tone setting information PR etc. recorded in a removable recording medium and edit the thus-acquired tone setting information PR etc. As a further alternative, the electronic musical instrument 10 may be constructed to acquire tone setting information PR etc. from another device via a communication I/F. Further, the non-volatile memory 30, which only needs to be a recording medium capable of storing various information, may be in the form of a flash memory or other type of memory, or any other medium like a hard disk drive.

Further, initial values of the condition information displayed in FIGS. 1C and 1D are not limited to default values. For example, in a case where parameter values are already set as tone setting information PR of an object-of-editing part, such parameter values may be made the initial values. Alternatively, parameter values that were being displayed on a previous editing screen may be made the initial values. Further, each link ID associated with tone setting information only needs to be information indicating that a common or same link is currently set for a plurality of tone setting information and capable of distinguishing that same link from other links, and such a link may be variously variable in its coding form, recording form, etc. as an identifier.

For example, each link ID corresponding to sets of tone setting information PR recorded in the tone setting information memory (regist memory) 30*a* need not necessarily be stored in the tone setting information memory (regist memory) 30*a*; in this case, correspondence between individual link IDs and sets of tone setting information PR may be stored in a separately-provided table or list. Further, the identifier assigned as the link ID may be any desired identifier, rather than limited to information indicative of an address of the link information memory 30*b* as noted above, as long as it is unique information capable of distinguishing among different links.

Furthermore, the scheme for reflecting edited content within a same regist is not limited to the operation of step S250 above. For example, the operation of step S250 may be replaced by an operation where, in response to modification of condition information of an object-of-editing part, content of link information 30*b* indicated by the link ID of the part may be modified simultaneously. In such a case, edited content can be reflected in tone setting information PR that is set to link within a same regist, by condition information of the link information 30*b* being read out to individual parts in the current area 40*a*.

Whereas the embodiments have been described in relation to the case where each set of tone setting information associated with a link ID is an entire collection of tone setting information for a performance part, the present invention is not so limited. For example, tone setting information for a performance part may be divided into a plurality of subsets, and one link ID may be associated with a set of tone setting information comprising one or more tone setting parameters included in each of the subsets. In this way, link setting according to the present invention can be performed on a portion, rather than the whole, of the tone setting information for one performance part.

What is claimed is:

1. An apparatus for setting tone setting information, which comprises:

a storage device storing a plurality of sets of tone setting information, each of the plurality of sets of tone setting information including one or more tone setting parameters, said storage device also storing, for each of the plurality of sets of tone setting information, a link ID identifying a link associated with a respective set of tone setting information; and a processor configured to cause, in response to an editing of a first set of tone setting information, settings of the tone setting parameters of a plurality of sets of the tone setting information having the same link ID as the link ID of the first set of tone setting information to match the edited first set of tone setting information.

2. The apparatus as claimed in claim 1, wherein said processor is further configured to edit selected one of the plurality of sets of the tone setting information in accordance with a user operation, and said processor is configured to cause a setting of any one of the tone setting parameters in one or more other sets of the tone setting information, having the same link ID as the link ID associated with the edited set of the tone setting information, to match a setting of the tone setting parameter in the edited set of the tone setting information.

3. The apparatus as claimed in claim 1, wherein said processor is further configured to select, from among already-set links, a link to be associated with selected one of the plurality of sets of the tone setting information in accordance with a user operation and store a link ID indicative of the selected ID in association with the selected one of the plurality of sets of the tone setting information, and wherein said processor is configured to cause a setting of any one of the tone setting parameters in the selected one of the plurality of sets of the tone setting information to match a setting of the tone setting parameter in one or more other sets of tone setting information having the same ID as the link ID of the selected link.

4. The apparatus as claimed in claim 1, wherein said processor is further configured to set a new link for selected one of the plurality of sets of the tone setting information in accordance with a user operation and store a link ID indicative of the set new link in association with the selected set of the tone setting information.

5. The apparatus as claimed in claim 1, which further comprises a link information memory that stores, in association with each link ID, the one or more tone setting parameters in a set of the tone setting information identified by the link ID, and wherein said processor is configured to cause, by referencing the link information memory based on the link ID, settings of the tone setting parameters to match between a plurality of sets of the tone setting information having the same link ID.

6. The apparatus as claimed in claim 1, wherein said storage device includes:

a registration memory storing a plurality of sets of registration data, each of the plurality of sets of registration data comprising a plurality of sets of tone setting information individually corresponding to a plurality of performance parts; and a current memory storing the plurality of sets of tone setting information constituting a set of registration data, the plurality of sets of tone setting information stored in the current memory being editable in accordance with a user operation, a set of registration data being writable or readable from the current memory into the registration memory or from the registration memory into the current memory, and said processor is configured to perform, in accordance with editing of any one of the sets of tone setting information stored in the current memory or editing of the link ID corresponding to the one of the sets of tone setting information, processing such that settings of the tone setting parameters match between the one of the sets of tone setting information and one or more others of the sets of tone setting information having the same link ID as the one of the sets of tone setting information.

7. The apparatus as claimed in claim 1, which further comprises a display device, and wherein said processor is further configured to:

present a single user interface screen on the display device so that, for editing of a set of the tone setting information, selecting any one of a plurality of predefined voices and selecting any one of a plurality of already-set links can be performed on the single user interface screen;

in response to selection of any one of the plurality of predefined voices, display the tone setting parameter for controlling the selected predefined voice so that the displayed tone setting parameter can be edited in accordance with a user operation; and in response to selection of any one of the plurality of already-set links, display the one or more tone setting parameters included in a set of the tone setting information corresponding to the selected already-set link so that any one of the displayed tone setting parameters can be edited in accordance with a user operation.

8. A method for setting tone setting information by use of a storage device storing a plurality of sets of tone setting information, each of the plurality of sets of tone setting information including one or more tone setting parameters, said method comprising:

storing, for each of the plurality of sets of tone setting information, a link ID identifying a link associated with a respective set of tone setting information, into the storage device; and causing, in response to an editing of a first set of tone setting information, settings of the tone setting parameters of a plurality of sets of the tone setting information having the same link ID as the link ID of the first set of tone setting information to match the edited first set of tone setting information.

9. A non-transitory computer-readable storage medium containing instructions executable by a processor to implement a method for setting tone setting information by use of a storage device storing a plurality of sets of tone setting information, each of the plurality of sets of tone setting information including one or more tone setting parameters, said method comprising:

storing, for each of the plurality of sets of tone setting information, a link ID identifying a link associated with a respective set of tone setting information, into the storage device; and causing, in response to an editing of a first set of tone setting information, settings of the tone setting parameters of a plurality of sets of the tone setting information having the same link ID as the link ID of the first set of tone setting information to match the edited first set of tone setting information.

* * * * *